US005941715A

United States Patent [19]

Huang

[11] Patent Number: 5,941,715

[45] Date of Patent: Aug. 24, 1999

[54] ELECTRIC CONNECTOR

[76] Inventor: A-Chao Huang, 4F, No. 11, Alley 7, Lane 83, Sec. 1, Ling Yun Rd., Wu Ku Hsiang, Taipei Hsien, Taiwan

[21] Appl. No.: 09/085,583

[22] Filed: May 27, 1998

[51] Int. Cl.[6] ..... H01R 9/09

[52] U.S. Cl. ..... 439/60; 439/637

[58] Field of Search ..... 439/636, 637, 439/747, 733.1, 60

[56] References Cited

U.S. PATENT DOCUMENTS

| | | | |
|---|---|---|---|
| 3,348,191 | 10/1967 | Kinkaid | 439/637 |
| 5,609,502 | 3/1997 | Thumma | 439/747 |
| 5,634,819 | 6/1997 | Pan | 439/637 |

*Primary Examiner*—Steven L. Stephan
*Assistant Examiner*—Javaid Nasri
*Attorney, Agent, or Firm*—Rosenberg, Klein & Bilker

[57] ABSTRACT

An electric connector for receiving an interface card (4), the connector including two rows of terminals (2 and 3), each terminal (2, 3) having a contact portion (22, 32) supported between a supporting portion (26, 36) and a retaining portion (23, 33) for positive contact with the inserted interface card (4), and an endpiece (27, 37) stopped against an inside wall of the casing of the electric connector to support the retaining portion (23, 33) against a stop edge (15, 16) inside the casing, the contact portions of the two rows of terminals (2 and 3) being disposed at different elevations so that less frictional resistance is produced when an interface card (4) is inserted into the electric connector.

3 Claims, 8 Drawing Sheets

ELECTRIC CONNECTOR

BACKGROUND OF THE INVENTION

The present invention relates to electric connectors, and more particularly to an interface card connector which greatly reduces the insertion force upon the insertion of an interface card, and firmly retains the inserted interface card in positive contact with respective terminals.

A regular electric connector for interface card is comprised of a casing having a longitudinal interface card insertion slot and two rows of terminals holes at two opposite sides of the interface card insertion slot, and a plurality of terminals respectively mounted in the terminal holes for connection to a circuit board. FIG. 6 shows an electric connector of this type. According to this electric connector, each terminal 60 comprises a smoothly arched springy portion 61 having a front end terminating in a downwardly extended contact portion 64 and a rear end terminating in a curved supporting portion 62 and then a mounting leg 63. When an interface card 65 is inserted into the interface card insertion slot, the downwardly extended contact portion 64 is retained in contact with a respective contact 651 at the interface card 65. This electric connector is still not satisfactory in function. The drawbacks of this structure of electric connector are outlined hereinafter.

1. When an interface card 65 is inserted into the interface card insertion slot, the inserted interface card 65 tends to be damaged by the rugged surfaces of the contact portions 64 of the terminals 60. If the gap between the two rows of terminals is relatively increased, the inserted interface card 65 may be moved relative to the terminals 60 when the electric connector is vibrated, causing the impedance to be increased.
2. Because the contact portion 64 of each terminal 60 is not a plane, the contact area between the inserted interface card 65 and each terminal 60 is a point of contact. Therefore, the interface card 65 tends to be damaged from the contact portions 64 of the terminals 60 when it is inserted into the interface card insertion slot. When the electroplating layer of the interface card 65 is damaged, it tends to be covered with rust, and a broken circuit tends to be occurred.
3. Because of point of contact between the inserted interface card 65 and each terminal 60, a high impedance is produced between the inserted interface card 65 and the terminals 60, and the machine may fail to work properly when a high temperature is produced during a high speed operation of the CPU of the circuit board to which the electric connector is connected.
4. Because the terminals 60 are mounted in the terminal holes on the casing individually by labor, much labor cost is required.

FIG. 7 shows another structure of electric connector for interface card according to the prior art. According to this structure of electric connector, each terminal 80 comprises an endpiece 82 at one end retained to one side of an inside flange 92 inside the casing 90, a curved portion 81 extended from the endpiece 82, a contact portion 83 downwardly extended from one end of the curved portion 81 remote from the endpiece 82, a supporting portion 85 connected to one end of the contact portion 83 remote from the curved portion 81 and secured to a hole 91 on the casing 90, and a mounting leg 84 or 86 downwardly extended from one end of the supporting portion 85 for mounting in a hole on the circuit board. This structure of electric connector still has drawbacks. The drawbacks of this structure of electric connector are as follows:

1. The fabrication procedure of the terminals 80 is complicated.
2. When the terminals are inserted into the respective terminal holes on the casing 90, the endpieces 82 of the terminals 80 may be stopped against the bottom edge of the inside flange 92, causing the terminals 80 to be deformed or broken.
3. The terminals 80 produce less clamping force to the inserted interface card, and the inserted interface card tends to be forced out of place when the electric connector is vibrated, causing the machine to fail.
4. Because the mounting legs 84;86 of the terminals 80 are spaced from the material strip 87 at both sides before the terminals 80 are cut from the material strip 87, the terminals 80 tend to be deformed or damaged during delivery, processing, electroplating or packing.

SUMMARY OF THE INVENTION

It is one object of the present invention to provide an electric connector for interface card which greatly reduces the insertion force upon the insertion of an interface card. It is another object of the present invention to provide an electric connector for interface card which firmly retains the inserted interface card in positive contact with respective terminals. It is still another object of the present invention to provide an electric connector for interface card which keeps the impedance between its terminals and the circuit board in stable, so that a temperature increase of the CPU on the circuit board does not causes affect its signal transmission. It is still another object of the present invention to provide an electric connector for interface card which can be conveniently assembled without consuming much labor. According to one aspect of the present invention, the electric connector comprises an electrically insulative casing having a longitudinal interface insertion slot and two rows of terminal holes, a plurality of first terminals and a plurality of second terminals respectively mounted in the terminal holes of the casing, the first terminals and the second terminals having respective contact portions for contacting the inserted interface card from both sides, wherein the contact portions of the first terminals and the contact portions of the second terminals are disposed at different elevations so that less insertion force is produced when an interface card is inserted into the interface card insertion slot. According to another aspect of the present invention, the contact portion of each terminal is supported between a vertical supporting portion and a retaining portion, and the retaining portion is stopped at a stop edge inside the respective terminal hole to force the contact portion into positive contact with the interface card. According to still another aspect of the present invention, each terminal has an endpiece stopped against an inside wall of the respective terminal hole to force the retaining portion against the respective stop edge inside the respective terminal hole, so that the respective contact portion is firmly retained in contact with the inserted interface card. According to still another aspect of the present invention, the first terminals and the second terminals are cut from a respective material strip, and the legs of the terminals are integral with the respective material strip and arranged on the same plane. Therefore, the terminals can be efficiently electroplated, and quickly installed in the casing of the electric connector.

DETAILED DESCRIPTION OF THE PREFERRED EMBODIMENT

Figure 1:
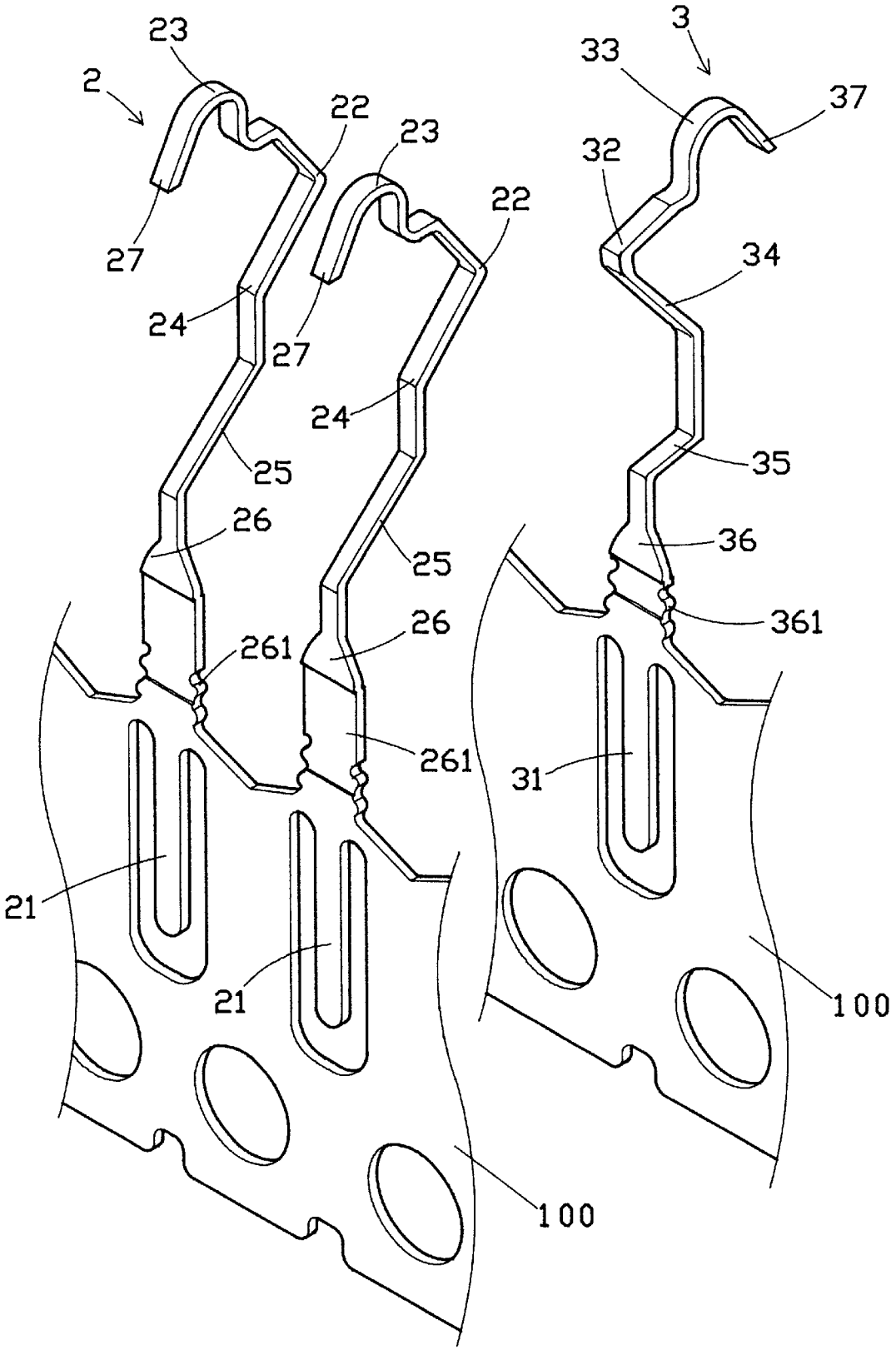
FIG. 1 shows first terminals and second terminals integral with a respective material strip according to the present invention.
Figure 2:
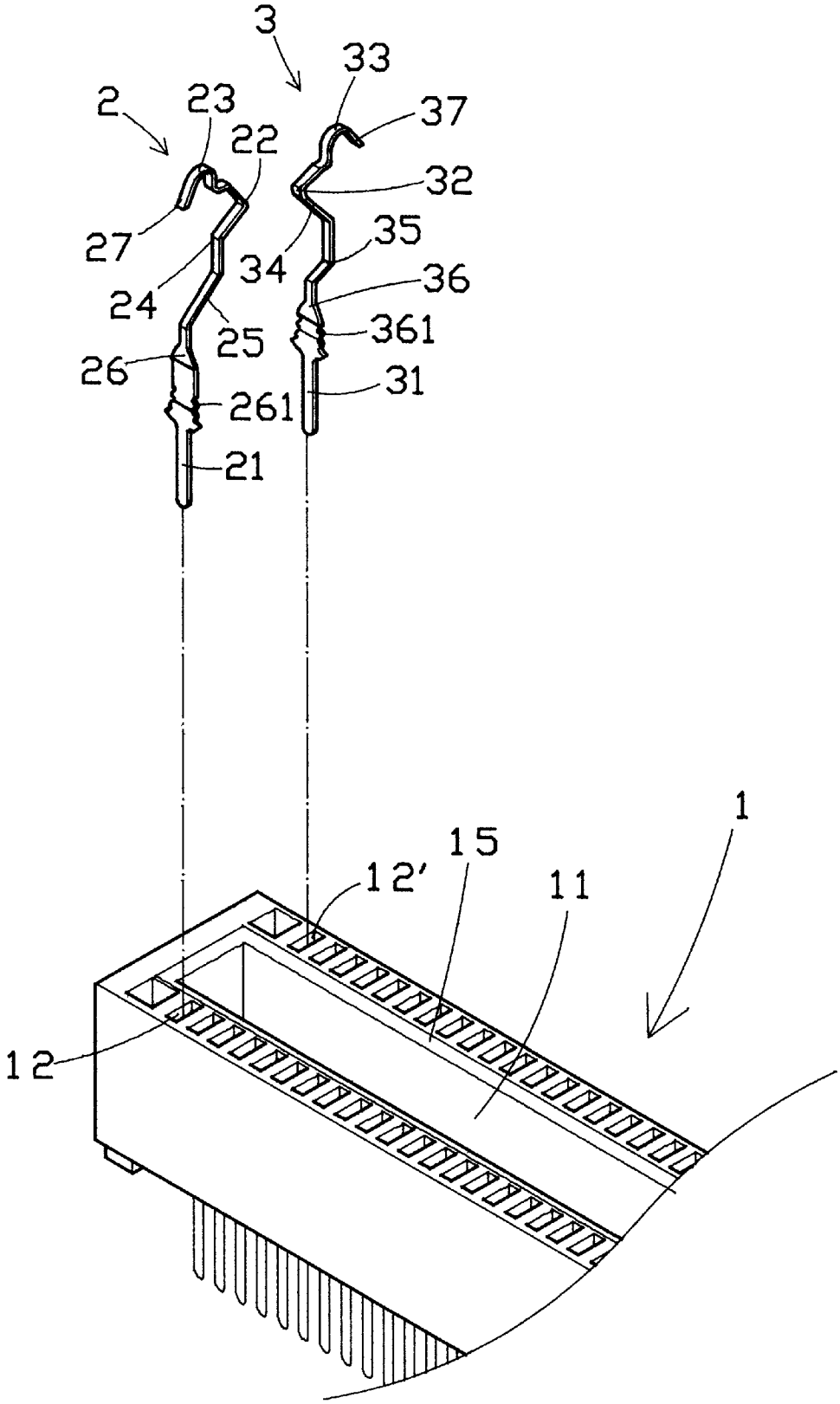
FIG. 2 is an exploded view of a part of an electric connector according to the present invention.

Referring to FIGS. 1 and 2, an electric connector in accordance with the present invention is generally comprised of a casing 1, a plurality of first terminals 2, and a plurality of second terminals 3.

Referring to FIGS. 1 and 2 again, the casing 1 is molded from electrically insulative material, comprising an elongated insertion slot 11 longitudinally disposed on the middle for receiving an interface card 4, first terminal holes 12 and second terminal holes 12' arranged into two parallel rows at two opposite sides of the elongated insertion slot 11 for receiving the first terminals 2 and the second terminals 3 respectively.

Figure 3:
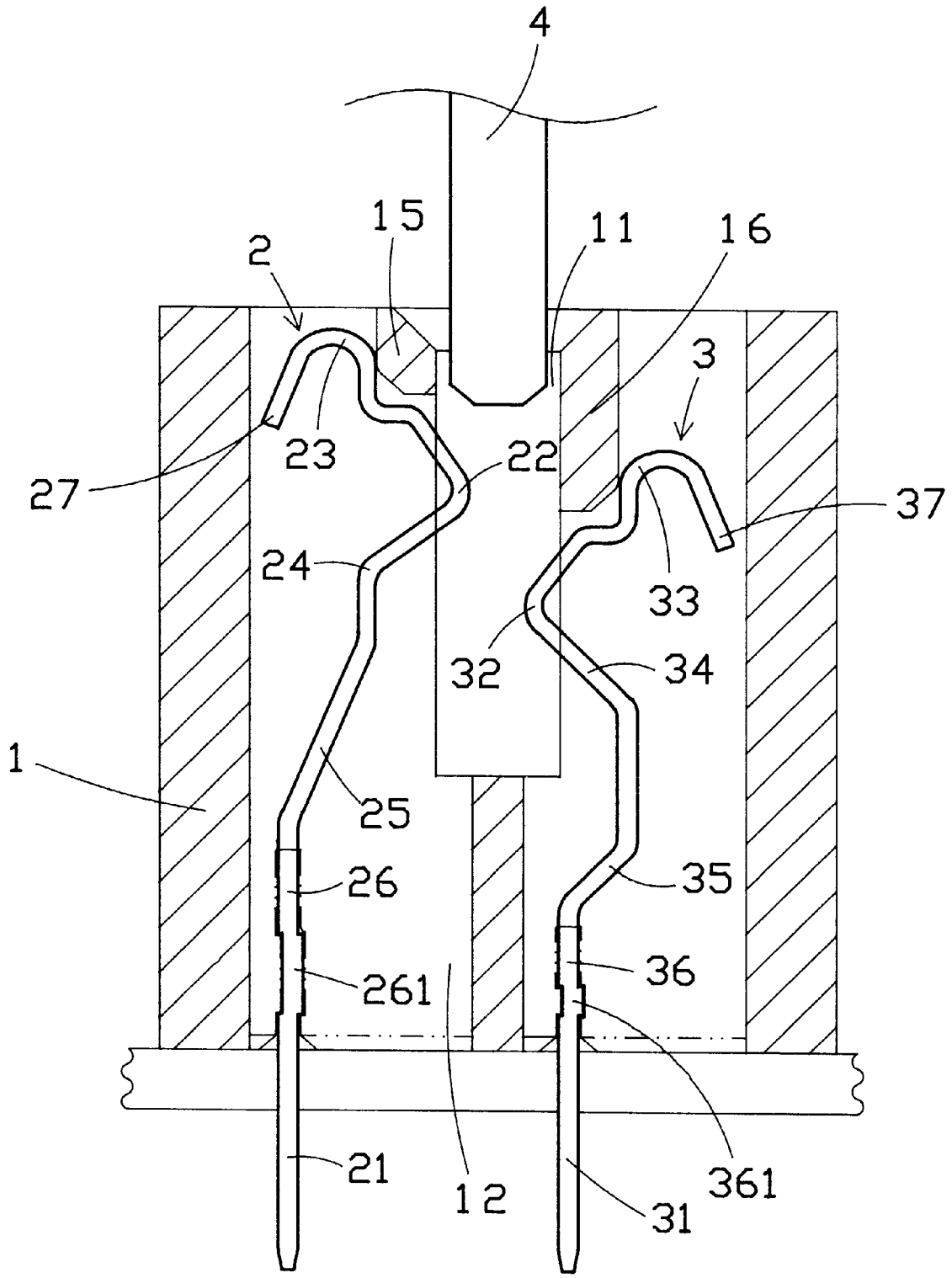
FIG. 3 is a sectional view of the present invention, showing first and second terminals installed in the casing.
Figure 4:
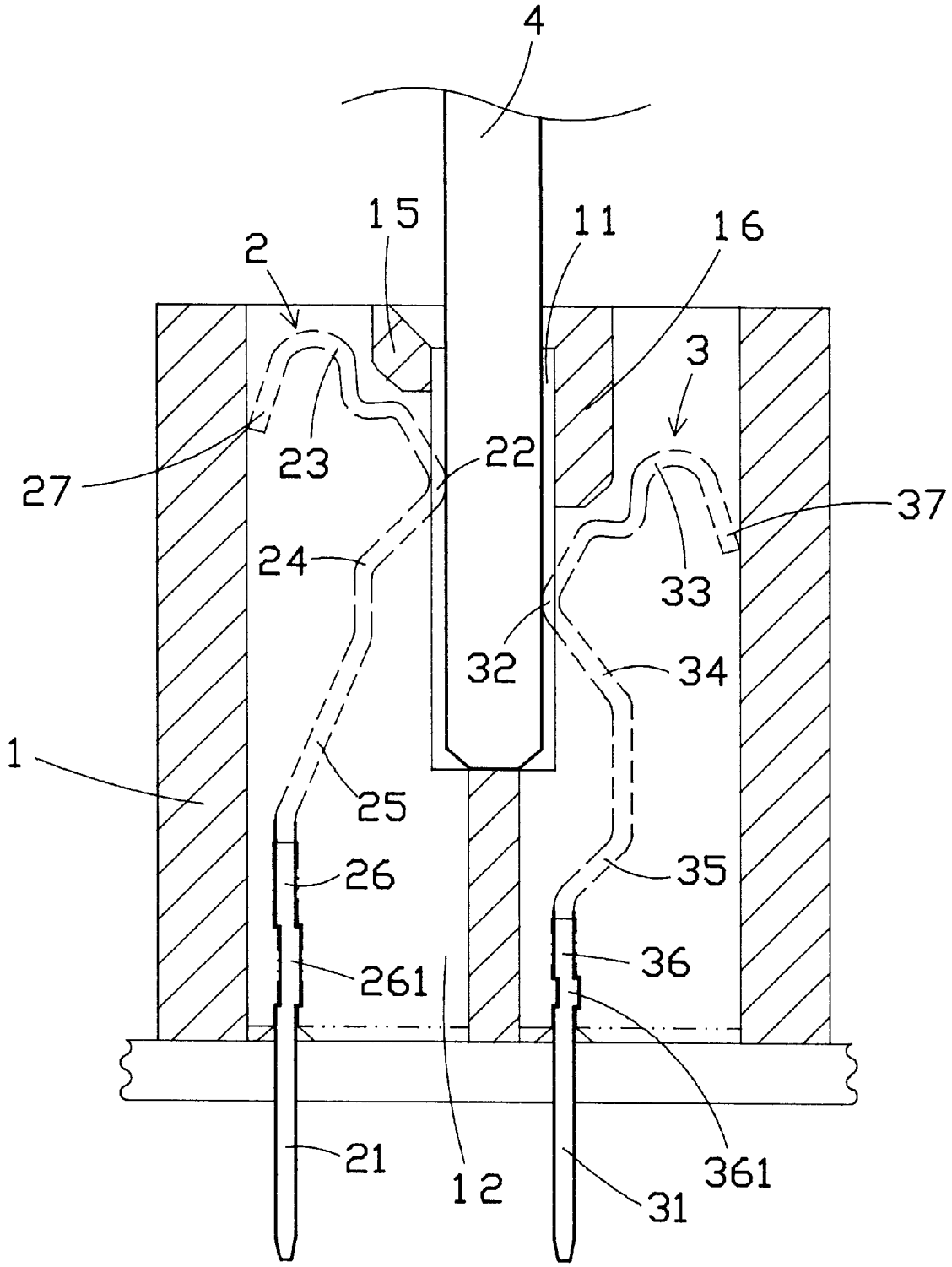
FIG. 4 is similar to FIG. 3 but showing the interface card inserted into the inside of the insertion slot of the casing.
Figure 5:
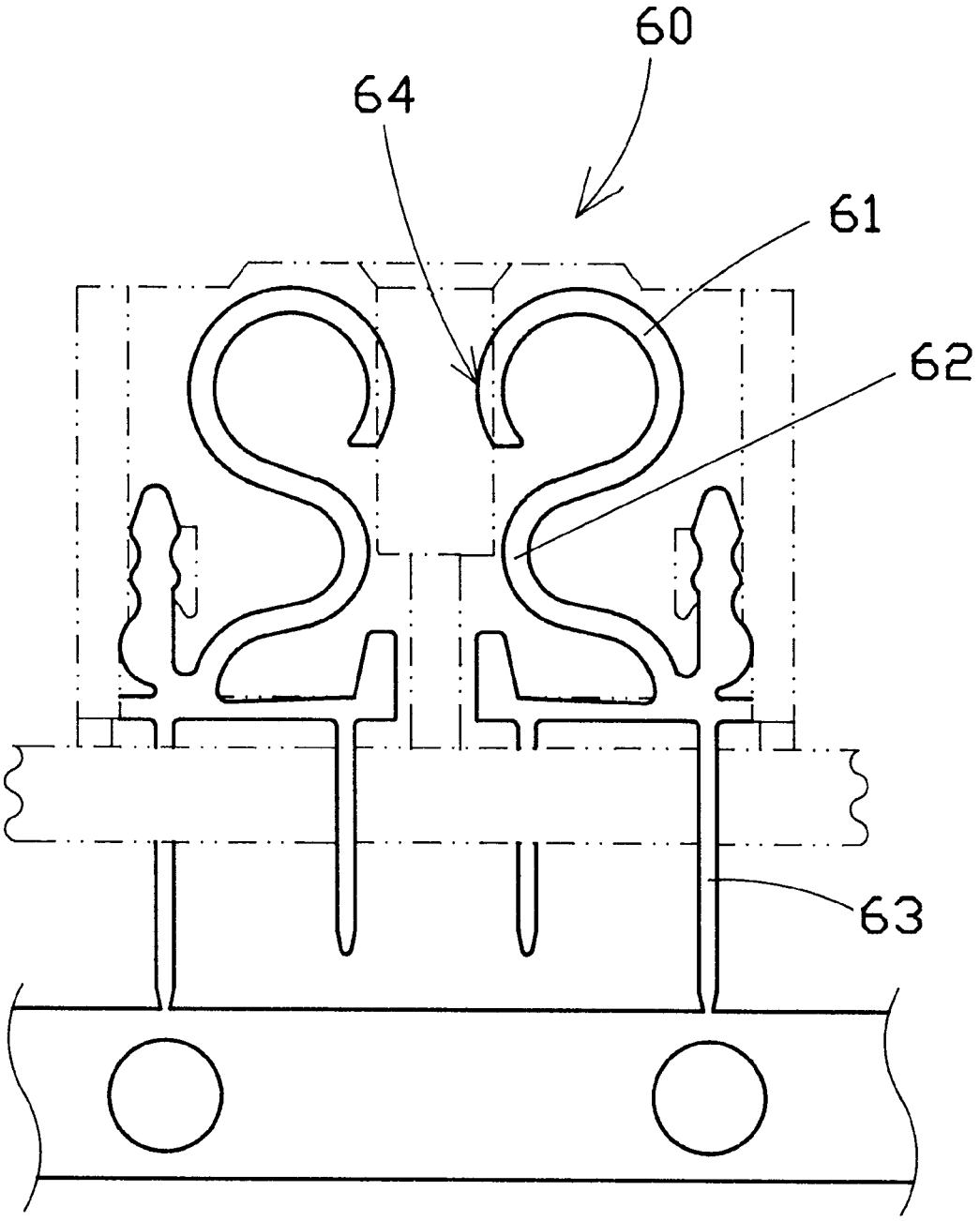
FIG. 5 is a sectional view of an electric connector for interface card according to the prior art.
Figure 6:
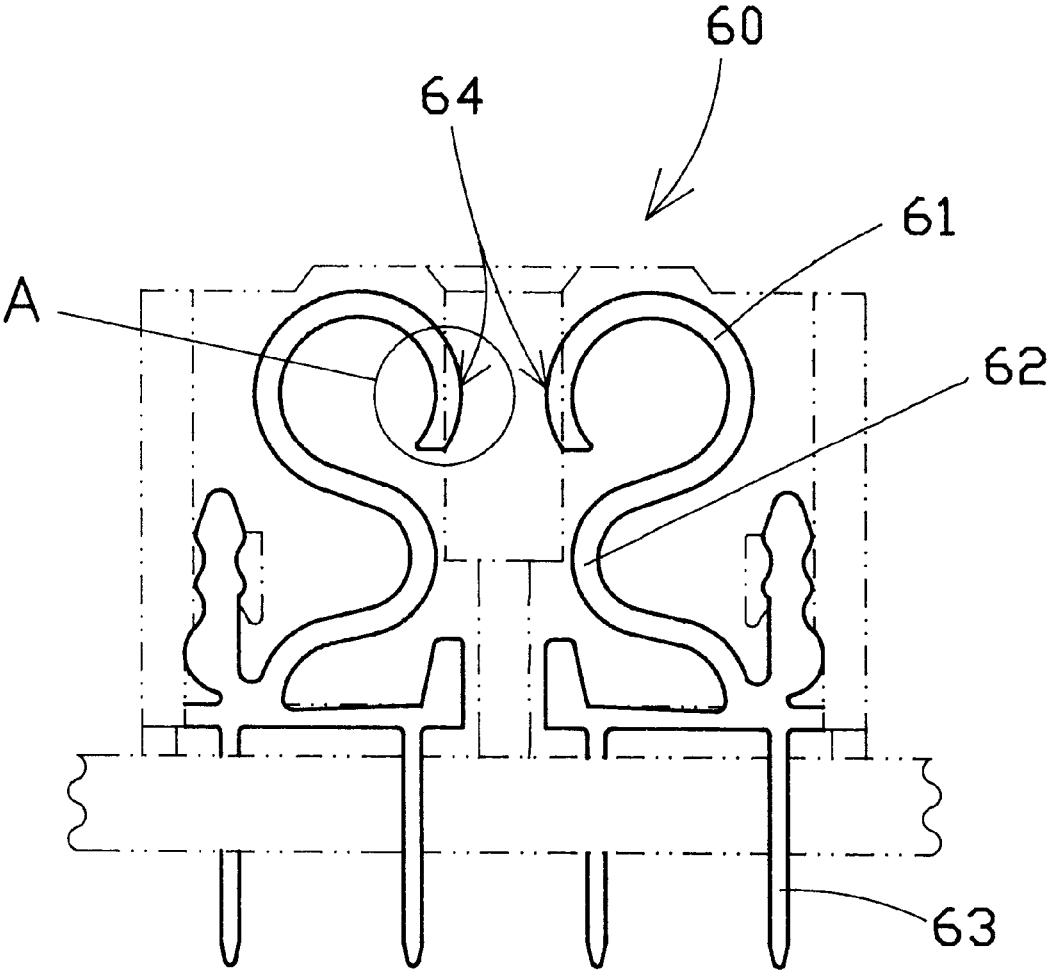
FIG. 6 is similar to FIG. 5 but showing the terminals cut from the material strip and an interface card inserted into the insertion slot of the electric connector.
Figure 6A:
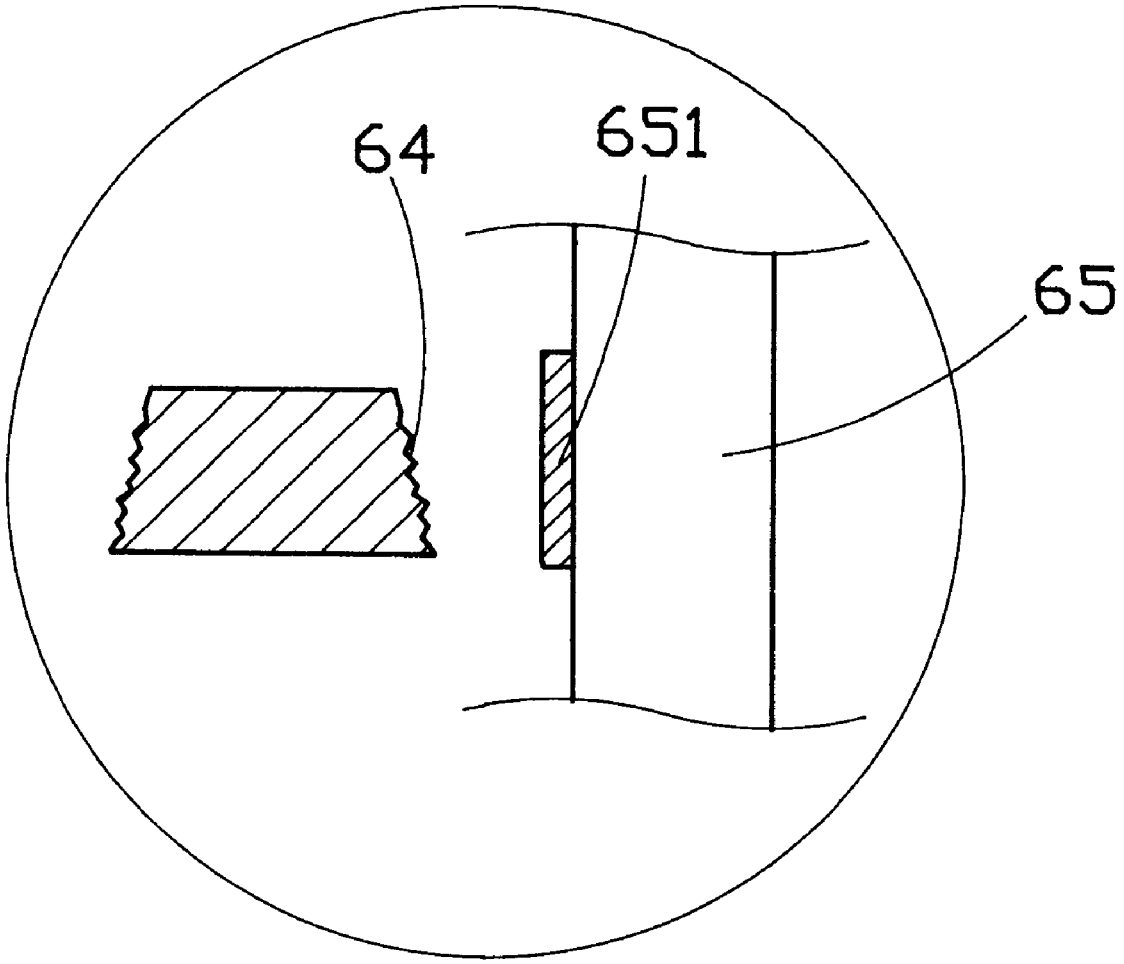
FIG. 6A is an enlarged view of a part of FIG. 6.
Figure 7:
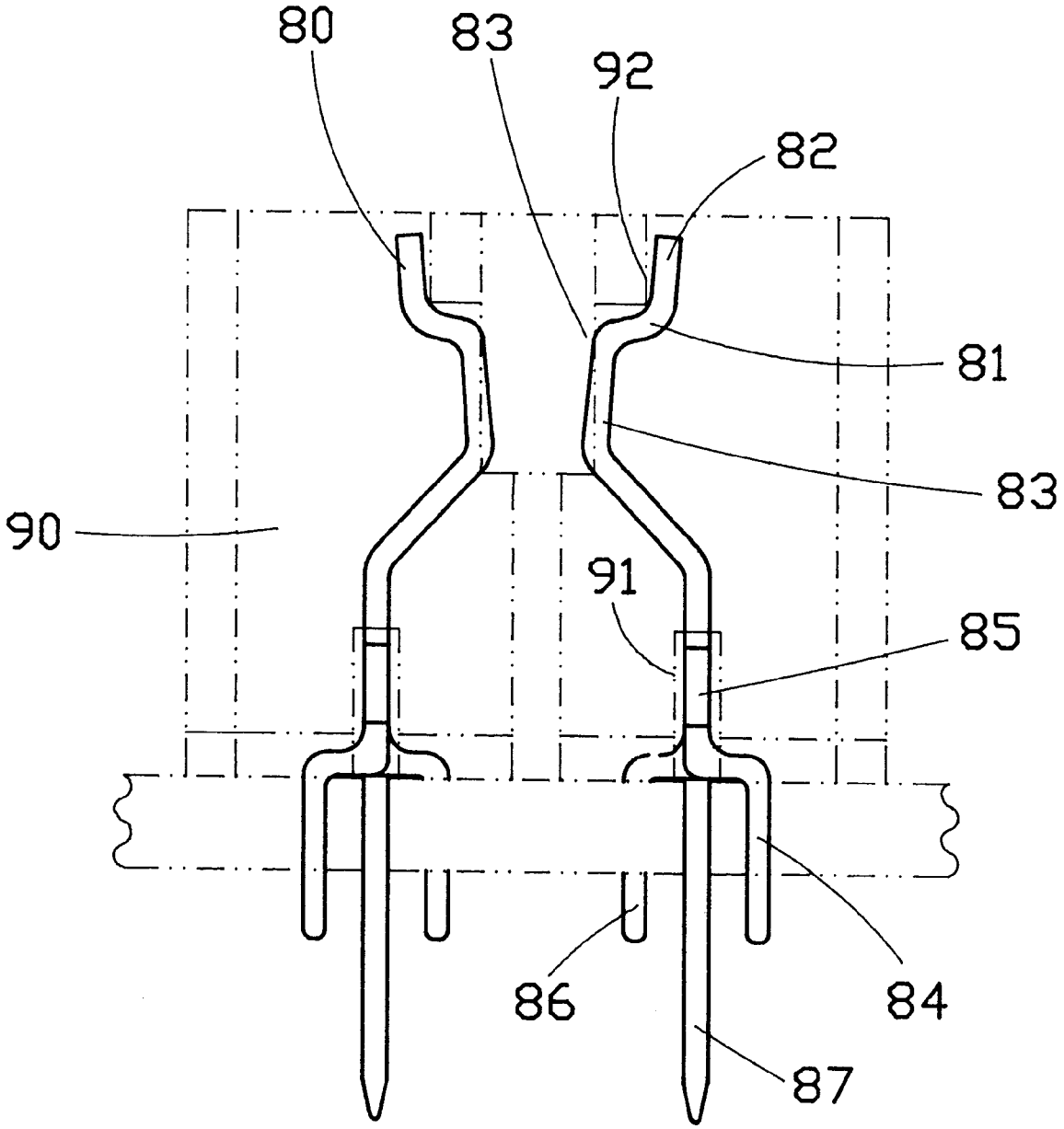
FIG. 7 is a sectional view of another structure of electric connector for interface card according to the prior art.

Referring to FIGS. 3 and 4 and FIGS. 1 and 2 again, the first terminals 2 are respectively mounted in the first terminal holes 12. Each first terminal 2 comprises an endpiece 27 at one end, a leg 21 at an opposite end extended out of the bottom side of the casing 1, a contact portion 22, a curved retaining portion 23 connected between the endpiece 27 and one end namely the top end of the contact portion 22, a bent portion 24 extended from an opposite end namely the bottom end of the contact portion 22, a vertical supporting portion 26 upwardly extended from the leg 21, a sloping connecting portion 25 connected between the vertical supporting portion 26 and the bent portion 24, and at least one projecting stop flange 261 raised from the vertical supporting portion 26. When one first terminal 2 is mounted in one first terminal hole 12, the downwardly extended leg 21 extends out of the bottom side wall of the casing 1 for connection to a circuit board, the contact portion 22 partially projects into the insertion slot 11, the curved retaining portion 23 is stopped at an edge 15 inside the respective first terminal hole 12, and the projecting stop flange 261 is stopped above the bottom side wall of the casing 1. When an interface card 4 is inserted into the insertion slot 11, the contact portion 22 is retained in contact with a respective contact at one side of the interface card 4, and the endpiece 27 is forced by the pressure of the inserted interface card 4 to stop at an inside wall of the casing 1, and therefore the first terminal 2 is firmly retained in contact with the inserted interface card 4.

Referring to FIGS. 3 and 4 and FIGS. 1 and 2 again, the second terminals 3 are respectively mounted in the second terminal holes 12'. Each second terminal 3 comprises an endpiece 37 at one end, a leg 31 at an opposite end extended out of the bottom side of the casing 1, a contact portion 32, a curved retaining portion 33 connected between the endpiece 37 and one end namely the top end of the contact portion 32, a sloping portion 34 extended from an opposite end namely the bottom end of the contact portion 32, a vertical supporting portion 36 upwardly extended from the leg 31, a bent portion 35 connected between the vertical supporting portion 36 and the sloping portion 34, and at least one projecting stop flange 361 raised from the vertical supporting portion 36. When one second terminal 3 is mounted in one second terminal hole 12, the downwardly extended leg 31 extends out of the bottom side wall of the casing 1 for connection to a circuit board, the contact portion 32 partially projects into the insertion slot 11, the curved retaining portion 33 is stopped at an edge 16 inside the respective second terminal hole 12', and the projecting stop flange 361 is stopped above the bottom side wall of the casing 1. When an interface card 4 is inserted into the insertion slot 11, the contact portion 32 is retained in contact with a respective contact at one side of the interface card 4, and the endpiece 37 is forced by the pressure of the inserted interface card 4 to stop at an inside wall of the casing 1, and therefore the second terminal 3 is firmly retained in contact with the inserted interface card 4.

Referring to FIGS. from 1 to 4 again, when the first terminals 2 and the second terminals 3 are respectively mounted in the respective terminal holes 12;12', the contact portions 22 of the first terminals 2 are disposed at a higher elevation than the contact portions 32 of the second terminals 3. Because the contact portions 22;32 are disposed at different elevations, less friction resistance is produced when an interface card 4 is inserted into the insertion slot 11 of the casing 1. The contact area between the inserted interface card 4 and the contact portion 22 or 32 is a plane, which does not damage the surface of the interface card 4. Because the retaining portions 23;33 are smoothly curved and respectively stopped at edges 15;16 inside the casing 1, the contact portions 22;32 are firmly retained in place and forced into positive contact with the inserted interface card 4. Because the endpieces 27;37 are stopped against the respective inside walls of the casing 1 when an interface card 4 is inserted into the insertion slot 11, the contact portions 22;32 are well supported and firmly retained in close contact with the inserted interface card 4. Therefore, the inserted interface card 4 does not disconnect from the terminals 2;3 when the electric connector is vibrated.

Referring to FIG. 1, the first terminals 2 and the second terminals 3 are cut from a respective material strip 100. The legs 21 or 31 are integral with the respective material strip 100 and arranged on the same plane. Because the legs 21;31 are protected by the respective material strip 100, the legs 21;31 of the terminals 2;3 will not be damaged easily during an electroplating process, packing work or transportation.

While only one embodiment of the present invention has been shown and described, it will be understood that various modifications and changes could be made thereunto without departing from the spirit and scope of the invention disclosed.

What the invention claimed is:

1. An electric connector comprising:

a casing molded from electrically insulative material, said casing comprising an elongated insertion slot for receiving an interface card, a row of first terminal holes and a row of second terminal holes arranged in parallel at two opposite sides of said insertion slot, said first terminal holes and said second terminal holes each having a vertical inside wall remote from said insertion slot, a bottom wall, and a stop edge adjacent to said insertion slot;

a plurality of first terminals respectively mounted in said first terminal holes, said first terminals each comprising an endpiece at one end thereof stopped against said vertical inside wall of a respective one of said first terminal holes responsive to insertion of the interface card into said insertion slot, a leg at an opposite end extended out of a hole in said bottom wall of a respective one of said first terminal holes for connection to a circuit board, a contact portion partially projecting into said insertion slot for contacting the inserted interface card and having a top end and a bottom end, a curved retaining portion connected between said endpiece and said top end of said contact portion of said first terminal and stopped below said stop edge of a respective one of said first terminal holes, a bent portion extended form said bottom end of said contact portion of said first terminal, a vertical supporting portion upwardly extended from said leg of said first terminal, a sloping connecting portion connected between said vertical supporting portion and said bent portion of said first terminal, and at least one projecting stop flange raised from said vertical supporting portion of said first terminal and stopped above said bottom wall of a respective one of said first terminal holes; and a plurality of second terminals respectively mounted in said second terminal holes of said casing, said second terminals each comprising an endpiece at one end thereof stopped against said vertical inside wall of a respective one of said second terminal holes responsive to insertion of the interface card into said insertion slot, a leg at an opposite end extended out of a hole in said bottom wall of a respective one of said second terminal, a contact portion partially projecting into said insertion slot for contacting the inserted interface card and having a top end and a bottom end, a curved retaining portion connected between said endpiece and said top end of said contact portion of said second terminal and stopped below said stop edge of a respective one of said second terminal hole, a sloping portion extended from said bottom end of said contact portion of said second terminal, a vertical supporting portion upwardly extended from said leg of said second terminal, a bent portion connected between said vertical supporting portion and said sloping portion of said second terminal, and at least one projecting stop flange raised from said vertical supporting portion of said second terminal and stopped above said bottom wall of a respective one of said second terminal holes.

2. The electric connector as recited in claim 1 where said stop edge of each of said first terminal holes is disposed at a higher elevation than said stop edge of each of said second terminal holes.

3. The electric connector as recited in claim 1 where said contact portion of each of said first terminals is disposed at a first predetermined elevation, said contact portion of each of said second terminals being disposed at a second predetermined elevation, said first predetermined elevation being higher than said second predetermined elevation.

* * * * *